United States Patent [19]

Fischer et al.

[11] 4,088,383

[45] May 9, 1978

[54] FAULT-CLOSABLE ELECTRICAL CONNECTOR

[75] Inventors: Allen Herbert Fischer, Creve Coeur; James Edgar Strauss, Maryland Heights, both of Mo.

[73] Assignee: International Telephone and Telegraph Corporation, New York, N.Y.

[21] Appl. No.: 714,556

[22] Filed: Aug. 16, 1976

[51] Int. Cl.[2] ..... H01R 13/52

[52] U.S. Cl. ..... 339/111

[58] Field of Search ..... 339/111

[56] References Cited

U.S. PATENT DOCUMENTS

| | | | |
|---|---|---|---|
| 3,945,699 | 3/1976 | Westrom | 339/111 X |
| 3,957,332 | 5/1976 | Lambert | 339/111 X |
| 3,958,855 | 5/1976 | Oakes | 339/111 |

*Primary Examiner*—Roy Lake
*Assistant Examiner*—DeWalden W. Jones
*Attorney, Agent, or Firm*—James B. Raden; William J. Michals

[57] ABSTRACT

A current responsive, gas-actuated bushing plug connector, for use with elbow connectors having a male electrode extending therefrom, is disclosed. The bushing plug includes an elastomeric housing in which a cylindrical, silver-plated insert body is coaxially mounted. The axially inner end of the insert body includes a threaded fastener for connection to an external circuit, and is thereby terminated to provide an enclosed chamber which opens at the other end of the insert body toward the mouth of the bushing plug. A removable and generally cylindrical piston assembly is slidably and coaxially mounted within the insert body. The removable assembly includes a metallic piston member having an annular piston head facing the inner end of the insert body and which encloses the chamber except at the axial bore of the piston member. A fixed minimum volume chamber is ensured by means of a stepped transition in the insert body which is spaced apart from the enclosed end thereof and which engages the circumferential portion of the piston head to limit the inward translation of the piston assembly. A garter spring encircles the piston member in a recessed groove therein. A cylindrical member of arc-responsive material which is removably fastened to the piston member, extends toward the mouth of the bushing plug and completes the external dimensions of the piston assembly. A tubular female contact is press-fitted within the assembly coaxially with the through-bore therein. The outer end of the female contact extends coaxially into the arc-responsive member in radially spaced-apart relationship therewith. A tubular insert tip member is mounted at the mouth of the bushing plug and is removably fastened to the outer end of the insert body. The tip member provides a stop member to limit the outward translation of the piston assembly.

24 Claims, 7 Drawing Figures

FAULT-CLOSABLE ELECTRICAL CONNECTOR

BACKGROUND OF THE INVENTION

This invention relates to current responsive, gas-actuated electrical connectors of the type embodied in a bushing plug for use in power distribution systems.

Electrical connectors wherein an arc is struck between relative movable electrodes and wherein the flow of an arc-extinguishing fluid or gas is caused by a plunger mechanism driven by the arc itself to extinguish the arc, are known and have been widely used in the art. These electrical connectors have the advantage that the power available for the plunger mechanism is therefore automatically increased with the current being handled. Such electrical connectors are exemplified in U.S. Pat. Nos. 1,955,215; 2,020,475; and, 3,542,986. More recently, these electrical connectors have been embodied in elbow and bushing plug configurations, as exemplified in U.S. Pat. No. 3,474,386, particularly for use in underground distribution systems.

While these electrical connectors have been satisfactory for their intended purpose, they are also complicated, complex, difficult to assemble and essentially impossible to disassemble, and are therefore expensive to manufacture. For example, once these more recent prior art current responsive, gas-actuated bushing plugs are assembled, a moving piston member assembly therein is permanently trapped within the confines of its cooperating cylinder and cannot be removed without destroying the bushing plug. Accordingly, the piston portion of the moving member assembly can neither be removed once the unit is in the field as, for example, for inspection or part replacement, nor even during the latter stages of the manufacturing process. Thus, when a single part of the piston assembly fails or becomes defective, from whatever cause, either during manufacture or in field operation, the entire bushing plug is essentially unusable and is therefore scrapped.

These and other disadvantages are overcome by the present invention wherein a bushing plug of the current responsive, gas-actuated type utilizing a movable piston assembly is provided. The entire bushing plug utilizes but a relatively small component count and is, moreover, structurally configured such that the moving piston assembly can readily be removed from the associated cylinder of the bushing plug, during manufacture and/or field operation. In a preferred embodiment, this is accomplished by utilizing a relatively small number of components which are threadedly engaged and removably fastened together to provide the overall bushing plug, thereby providing the attendant advantages of the prior art while avoiding the disadvantages thereof.

SUMMARY OF THE INVENTION

Briefly, a bushing plug having a movable female contact for receiving and making connection with the arc-follower terminated male electrode of an associated elbow connector is provided. The preferred bushing plug, in accordance with the present invention, comprises an elastomeric housing having a generally tubular configuration about a longitudinal axis thereof. A generally tubular metallic insert body is fixedly mounted within the housing and generally coaxially therewith. The body includes a threaded bore at one end thereof for receiving a fixed threaded external fastener which projects into the adjacent end of the housing and the body includes a generally cylindrical chamber therein which opens into the other end of the housing. A cylindrical piston assembly is slidably and coaxially mounted within the cylinder of the body and includes a tubular metallic piston member having an annular piston head portion at one end thereof which portion faces said one end of the insert body. The assembly further includes a tubular insert insulating member fastened to the other end of the piston member and extends coaxially therewith toward the other end of the housing thereby completing the external dimensions of the piston assembly and wherein the axial bores of the piston and insert members form a through bore extending through the piston assembly. A tubular female contact is coaxially press fitted within the piston member for movement therewith. A tubular insert tip member is coaxially threadedly mounted at the other end of the housing and is fastened to the other end of the insert body to complete the bushing plug.

BRIEF DESCRIPTION OF THE DRAWING

The advantages of this invention will become more readily appreciated as the same becomes completely understood by reference to the following detailed description when taken in conjunction with the accompanying drawing wherein.

DETAILED DESCRIPTION

Figure 1:
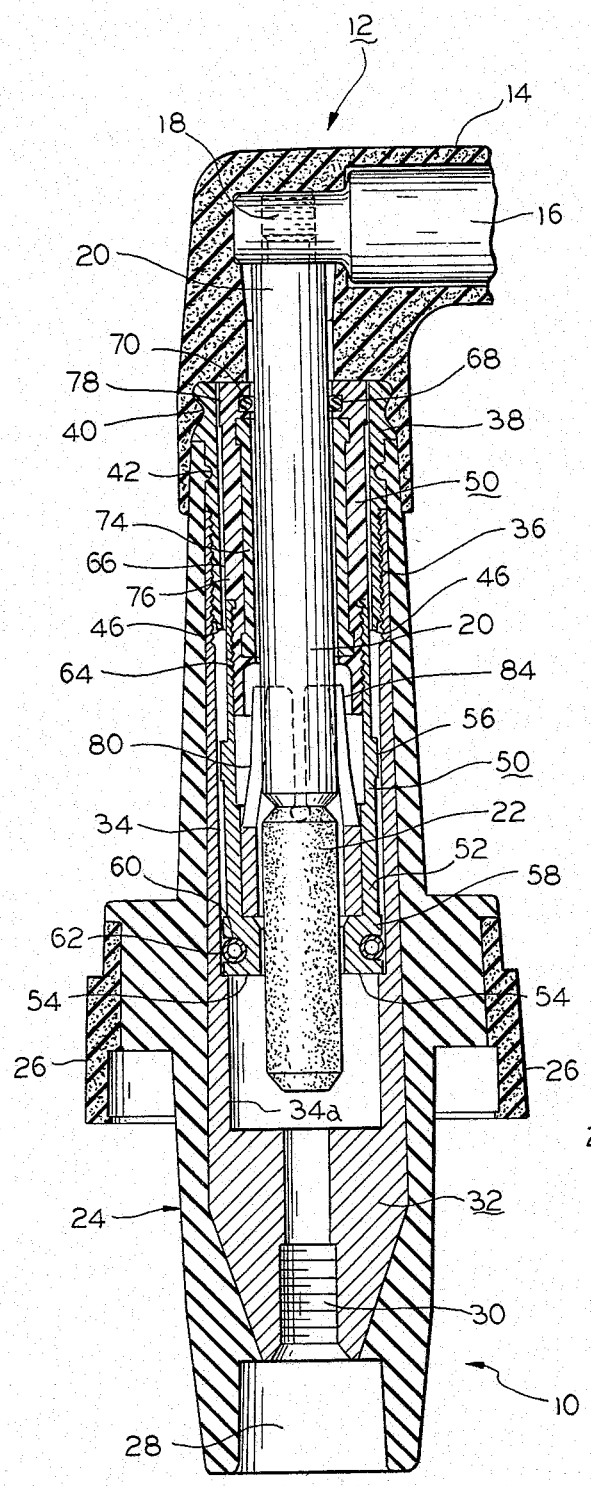
FIG. 1 is a side elevation, cross-sectional view of an electrical connector of the current responsive, arc or gas-actuated type in accordance with the principles of the present invention.
Figure 2:
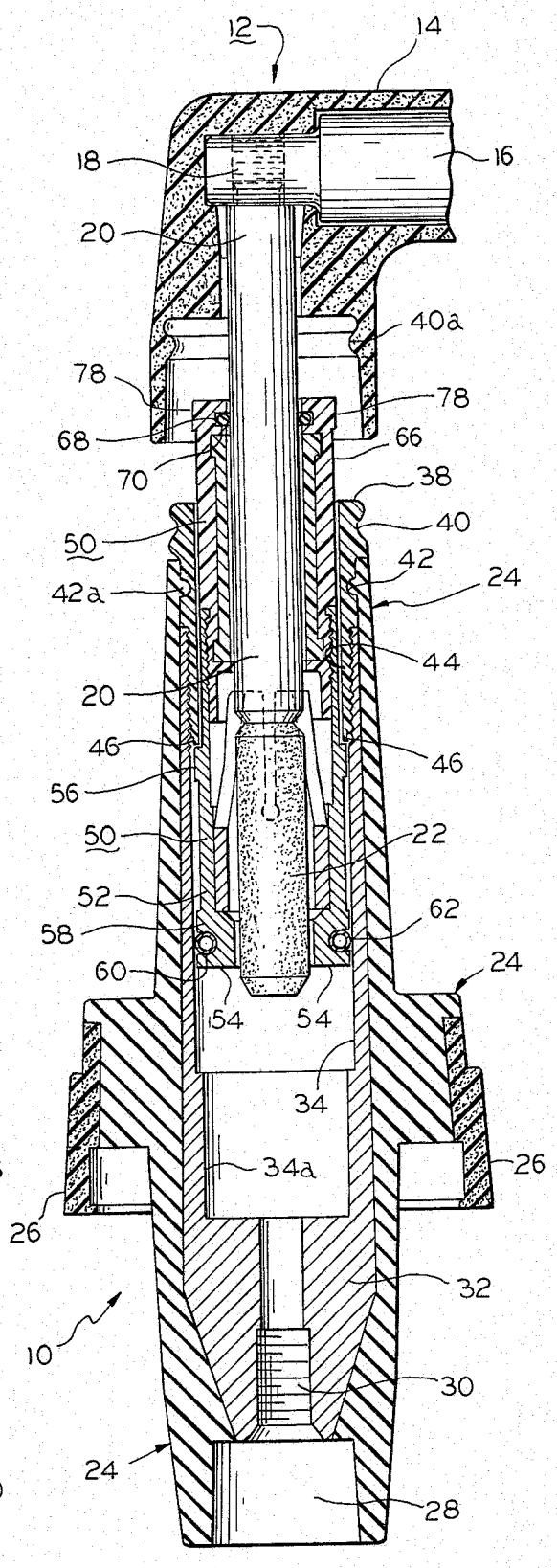
FIG. 2 is a similar sectional view of the connector of FIG. 1 and which illustrates the maximum outward translation of the piston assembly therein such as occurs during a circuit breaking or making operation of the connector in accordance with the present invention.

Referring now to FIGS. 1 and 2, there are shown cross-sectional views of bushing plug 10, in accordance with the principles of the present invention, and illustrated in conjunction with a partial view of the central portion of an associated elbow connector 12. The portions of elbow 12 illustrated in FIGS. 1 and 2 are essentially cut-away portions illustrating only so much of an elbow connector as is necessary for a better understanding of the present invention. That is, elbow connector 12, as shown in FIGS. 1 and 2, includes a central semiconductive insert portion 14 which receives a cable lug 16 therein. Lug 16 is provided with a threaded bore 18 for receiving the threaded end of a male electrode 20. The male electrode 20 is terminated at its end portion with an arc follower member 22 comprising an arc-responsive material which generates arc-extinguishing gases in the presence of an electrical arc drawn between the electrodes of the connection, as is well known in the art.

Bushing plug 10, in accordance with the present invention, includes a conventional elastomeric housing 24 having a layer of semi-conductive elastomeric material 26 about an outer circumference thereof and receiving the projecting threaded fastener (not shown) of an associated bushing well (not shown) through a lower opening 28 thereof. In this manner, bushing plug 10 can be mounted to a transformer, a switching panel or any other suitable surface or apparatus. The projecting threaded fastener of the associated bushing well engages a threaded portion 30 of a generally tubular metallic insert body 32 which is fixedly mounted within housing 24 such as by being permanently molded therein. The threaded bore 30 is preferably a through-hole bore to facilitate the initial machining operation which provides the threaded bore. It will be appreciated that once insert body 32 threadedly engages the projecting threaded fastener of the bushing well, the lower portion of insert body 32 is essentially sealed. Insert body 32 is provided with a cylindrical chamber 34 coaxial therewith and includes a stepped portion at its lower end thereof to provide a depending chamber 34*a*, of a reduced diameter. Thus, insert body 32 provides an enclosed chamber which opens into the outer end of housing 24 at its electrode receiving mouth portion. The upper end of insert body 32 includes a threaded portion 36 for receiving a tubular insert tip member 38. In currently preferred practice, insert body 32 is silver-plated to provide better electrical contact with the associated moving contact assembly which is described hereinafter.

Member 38 is of conventional construction in that recesses 40 and 42 which encircle member 38 are provided for engaging radially inwardly extending ribs 40*a* and 42*a* of elbow 12 and bushing plug 10, respectively. Accordingly, a seal is provided between the elbow and bushing plug once the two parts are fully engaged. In accordance with a feature of the present invention, member 38 is further provided with a threaded radially reduced portion 44 which engages threaded portion 36 of insert body 32. As will be discussed more fully hereinafter, member 38 is assembled with housing 24 and insert body 32 after the moving piston assembly is inserted into the axial chamber or cylinder portion of insert body 32, thereby to complete the bushing plugs. The radial dimension of portion 44 of member 38 is selected such that a fixed stop 46 is circumferentially provided at the lower end portion of member 38. This stop cooperates with the structure of the piston assembly to limit the maximum upward translation of the latter, as will be described more fully hereinafter.

Slidably disposed within the cylindrical chamber 34 of insert body 32 of bushing plug 10 is a movable cylindrical piston assembly 50, in accordance with the principles of the present invention. Piston assembly 50 includes a tubular metallic piston member 52 which preferably comprises a relatively light material, such as aluminum, to effectively reduce the mass thereof and thereby the overall mass of piston assembly 50. Piston member 52 includes an annular piston head portion 54 at its lower end thereof which provides an axial bore which receives arc follower 22 in spaced-apart relationship therewith. That is, the inside diameter of the annular piston head portion 54 exceeds the outside diameter of arc follower 22 by a given dimension thereby to permit the free passage of arc-generated gases therethrough. The size of the resulting gap is somewhat judiciously selected so as to provide an essentially unobstructed passage for the gas without sacrificing the cross-sectional area of piston head 54. This optimum trade-off provides rapid initial translation of piston assembly 50 upon the development of gas pressure within the stepped chamber portion 34*a* of insert body 32. Further, the longitudinal dimensional of the stepped or depending chamber 34*a* is selected so as to provide a minimum fixed volume chamber thereat, and to accomodate the longitudinal projection of arc follower 22 when elbow 12 and bushing plug 10 are fully engaged.

The piston member 52 is provided with two circumferentially disposed and radially outwardly extending raised portions 56 and 58. This is done so that the outside diameter of piston member 52, at raised portions 56 and 58, can be readily controlled during the machining or manufacturing operation without having to maintain a close tolerance throughout the entire longitudinal dimension of piston member 52. The portion of member 52 between raised portions 56 and 58 also accommodates any expansion of member 52 resulting from the assembly of the female contact therein. Further, raised portion 58 includes a recessed groove 60 which encircles the lower portion of piston member 52 and which receives a garter spring 62 circumferentially disposed therein. Although sliding electrical contact is provided between raised portions 56 and 58 and the inside diameter of cylinder chamber 34 of insert body 32, the garter spring 62 further ensures such electrical contact throughout the translation range of piston assembly 50. Further, piston member 52 may include a plurality of recessed grooves respectively receiving individual garter springs to suit a given application.

The upper end of piston member 52 is provided with a threaded portion 64 along the inside diameter thereof which threadedly engages a tubular insert insulating member 66. Member 66 comprises an arc-responsive material which liberates arc-extinguishing gases in the presence of an arc drawn between adjacent electrodes. The upper end of insert member 66 is provided with a recessed groove 68 along its inside diameter thereof for receiving an O-ring 70 therein. Insert member 66 preferably includes an inner coaxial sleeve member 74 having superior arc-quenching properties. That is, the radially outer portion 76 of insert member 66 provides the desired strength and mechanical properties, while the radially inner sleeve 74 provides enhanced arc-extinguishing properties. The upper end of insert member 66 includes a stepped or raised peripheral portion 78 whose outside diameter is selected to provide the desired clearance between insert member 66 and the internal diameter of the outer portion of member 38.

Finally, piston assembly 50 includes a female contact member 80 which is preferably press-fitted within the lower chamber of piston member 52 and which is provided with an axial bore therethrough for receiving the arc-follower terminated electrode 20 therein.

Figure 3:
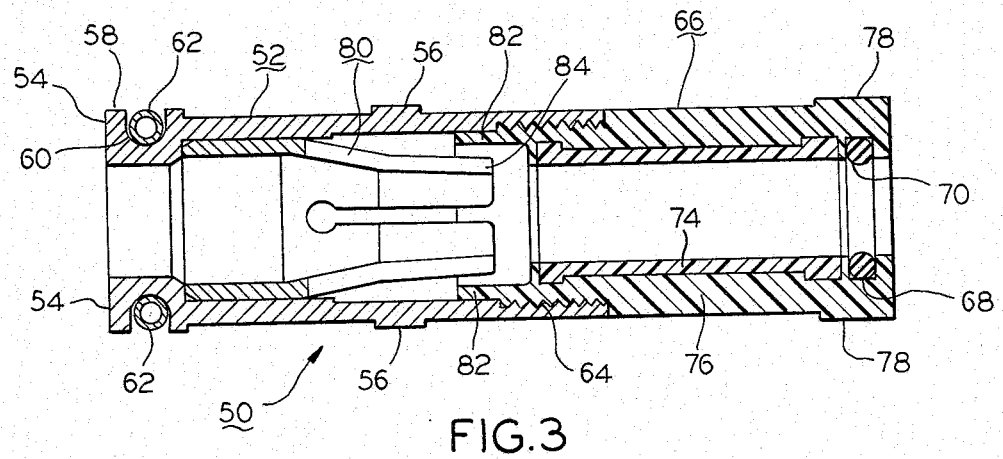
FIG. 3 is an enlarged cross-sectional view taken along the longitudinal axis of the piston assembly of FIGS. 1 and 2.
Figure 4:
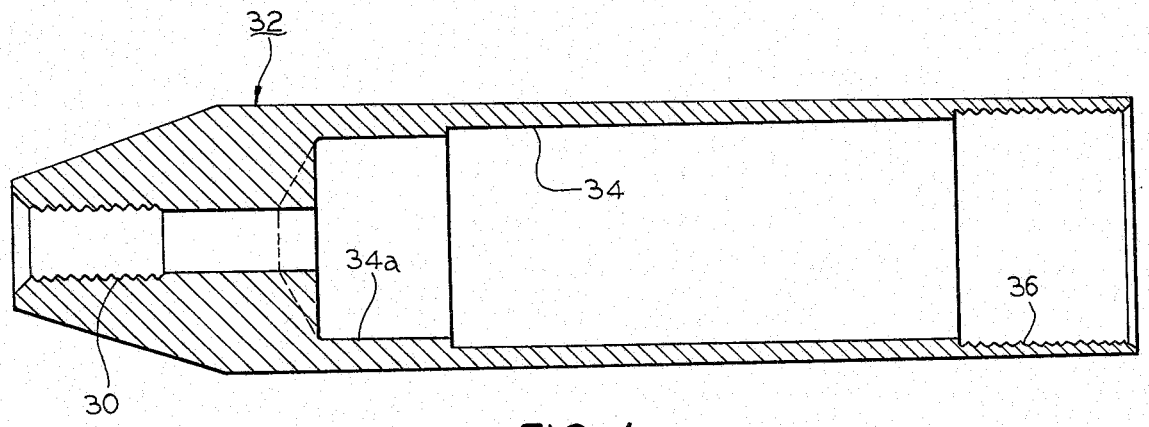
FIG. 4 is a similar cross-sectional view of the insert body which forms a cylinder for receiving the piston assembly of FIG. 3.
Figure 5:
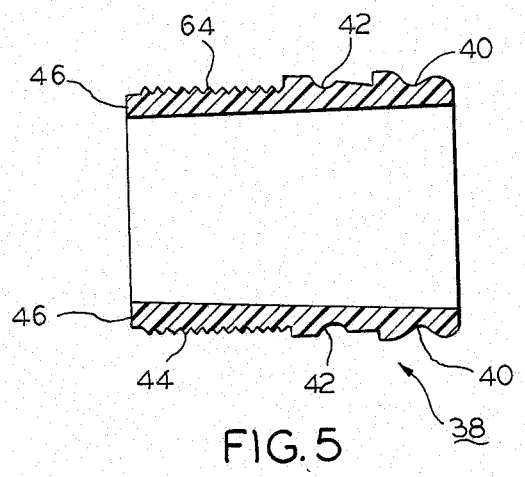
FIG. 5 is a cross-sectional view taken along the longitudinal axis of the arc snuffer tip member illustrated in FIGS. 1 and 2; and, FIGS. 6a and 6b are cross-sectional views of an alternate embodiment of a connector bushing plug in accordance with the present invention.

Referring now to FIGS. 3–5, there are shown enlarged views of the piston assembly 50, insert body 32 and insert tip member 38 and which illustrate somewhat more clearly the dimensional relationships of the components which provide the bushing plug in accordance with the present invention. It should now be appreciated that in the preferred embodiment of the present invention, the bushing plug comprises but six individual components which are threadedly engaged or assembled in such a manner that the bushing plug and, more particularly, the piston assembly therein can be readily disassembled during manufacture or field operation.

Referring now to FIG. 3, it can be seen that insert member 66 includes a longitudinally inwardly extending portion 82 forming a shroud which extends telescopically about the end portion 84 of female contact 80. The shroud is provided to avoid arcing between the advancing male electrode and the adjacent portions of piston member 52. The function of "O"-ring 70 is twofold. First, the friction fit between O-ring 70 and arc follower 22 during the initial advancement thereof ensures that piston assembly 50 is fully translated to its downward or initial position during each closing operation of elbow 12 and bushing plug 10. Secondly, "O"-ring 70 serves to confine the gas generated within piston assembly 52 so that essentially all of the resulting gas is channeled toward the piston head portion 54 of the differentially acting piston assembly 50.

Referring now to FIG. 4, it can be seen that the outside diameter of insert body 32 is provided with a somewhat tapered configuration which reduces toward the threaded portion 36. This taper functions to improve the shape of the electrical field within the surrounding insulation of housing 24. Referring now to FIG. 5, it can be seen that insert tip member 38 is provided with a tapered configuration along its inside diameter. This tapered configuration, as illustrated somewhat more clearly in the enlarged view of FIG. 5, is provided to facilitate the molding operation of insert tip member 38. That is, the tapered configuration provides a draft to facilitate ready removal of member 38 from the steel mandril of the mold structure which provides the axial bore of tip insert member 38.

Turning now to a brief description of the closing or circuit making operation of the bushing plug 10 of FIGS. 1 and 2, it should now be appreciated that as the electrode of elbow 12 is initially inserted into piston assembly 50, assembly 50 is translated to the position depicted in FIG. 1. That is, if piston assembly 50 is not at its lowermost position, the friction fit between arc follower 22 and "O"-ring 70 of piston assembly 50 translates piston assembly 50 to the position wherein annular piston head 54 rests against the transition portion of insert body 32. Thereafter, the electrode 20 with its arc follower tip 22 continues to advance into the axial through-bore of piston assembly 50 until electrode 20 is sufficiently close to the upper most portion of female contact 80 to strike an arc between electrode 20 and female contact 80. This arc normally occurs when electrode 20 and contact 80 are within $\frac{1}{8}$ to $\frac{1}{4}$ inch of one another. Once the arc is struck, arc gas is generated and the surrounding arc-responsive materials liberate an arc-extinguishing gas. The gases are channeled downwardly through the separation between the bore of piston head 54 and the arc-follower and a pressure is developed within reduced chamber **34*a*. This pressure acts on piston head 54 in a differential manner to translate piston assembly 50 upwardly so that female contact 80 engages male electrode 20** and thereby extinguishes the arc.

The gas pressure generated within chamber **34*a* is a function of the arc current. Accordingly, as the load current increases up to and including fault current levels, the speed of operation of bushing plug 10**, in accordance with the present invention, increases proportionately.

It will now be appreciated by those skilled in the art that if during the manufacturing operation or field use of bushing plug 10 it should become necessary to remove piston assembly 50 from bushing plug 10, this is readily accomplished by simply removing threaded insert tip member 38 and sliding piston assembly 50 away from insert body 32 and bushing plug 10. Thus, in accordance with the present invention, it is not only possible but also relatively simple to inspect and replace a defective or questionable component and, more particularly, to reuse and re-assemble the other components, thereby to salvage the bushing plug.

Figure 6A:
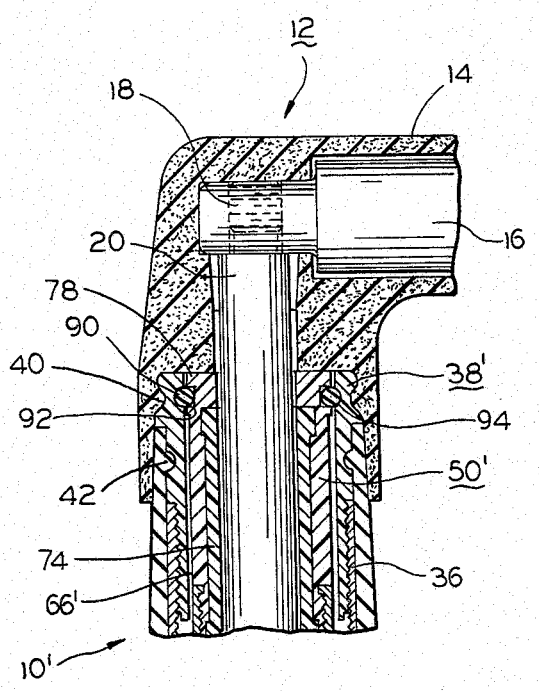
Figure 6B:
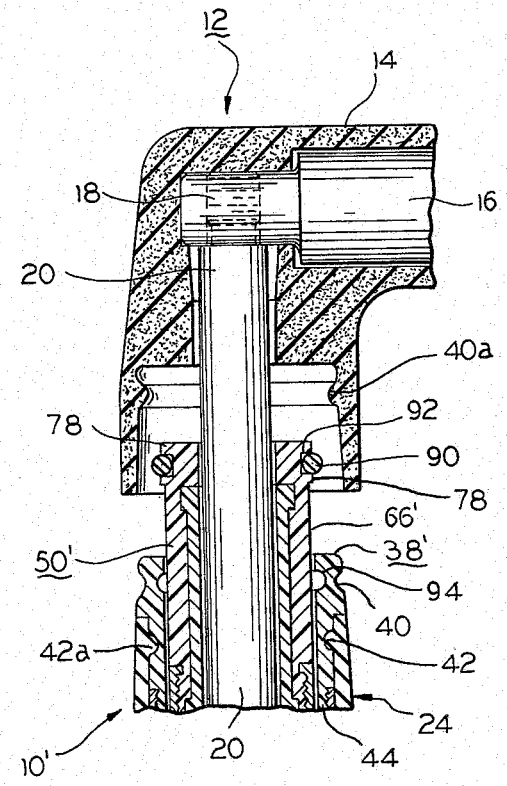

Referring now to FIGS. 6a and 6b there are shown partial cross-sectional views of an alternate embodiment of the bushing plug in accordance with the present invention. Bushing plug 10' is similar to bushing plug 10 of the previous drawing figures and accordingly like elements bear like reference numerals. However, those elements manifesting a significant structural change or variation are so designated by means of a prime. With respect to FIGS. **6*a* and 6*b*, the previously described "O"-ring 70 and recessed groove 68 are deleted from the structure of insert member 66'. In this embodiment insert member 66' receives an "O"-ring 90 in a recessed groove 92 which is provided along the outside diameter of insert member 66'. Insert tip member 38' is provided with a corresponding and somewhat shallower groove 94** on the inside diameter thereof which functions as an "O"-ring seat.

In the initial or closed position, as illustrated in FIG. **6*a*, it can be seen that insert member 66' is snapped into insert tip member 38'. This arrangement provides a releasable, snap-lock and friction-fitting engagement between insert member 66' and insert tip member 38'. Thus, during normal operation of bushing plug 10', piston assembly 50' is trapped and retained in its downwardly translated position. That is, the retaining frictional force provided by this engagement is greater than the force required to disengage male electrode 22 from female contact 80. However, piston assembly 50' is releasably retained in the operative position for a subsequent fault closing. Thus, if bushing plug 10' is subsequently closed under fault conditions, the resulting gas pressures, and therefore the axially outward forces on piston assembly 50', are sufficient to overcome the retaining frictional force thereby to translate piston assembly 50'** into mechanical and electrical contact with the advancing male electrode.

Accordingly, the embodiment of the present invention illustrated in FIGS. **6*a* and 6*b* has the advantage that piston assembly 50' is normally always in its initial or cocked position, ready for a fault closing operation. The seal provided by and between "O"-ring 90 and the cooperating structure of grooves 92 and 94 also functions to reduce the possibility of arc flashovers in the nominal clearance area between insert member 66' and insert tip member 38'. While "O"-ring 90 is preferably carried by piston assembly 50', it will be appreciated that the relative positions of grooves 92 and 94 can be reversed wherein "O"-ring 90 is carried by, and fixedly mounted within, insert tip member 38'**.

What has been taught, then, is an arc-responsive, gas-actuated, fault-closable bushing plug facilitating, notably, repeated assembly, disassembly and re-assembly thereof. The form of the invention illustrated and described herein is but a preferred embodiment of these teachings in the form currently preferred for manufacture. It is shown as an illustration of the inventive concepts, however, rather than by way of limitation, and it is pointed out that various modifications and alterations may be indulged in within the scope of the appended claims.

What is claimed is:

1. A bushing plug having a movable female contact for receiving and making engaging connection with the male electrode of an associated elbow connector, said bushing plug comprising:

an elastomeric housing having a generally tubular configuration about an axis thereof and terminating at either end thereof in a mouth;

a generally tubular metallic insert body fixedly and coaxially mounted within said elastomeric housing, said insert body having a means at one end thereof for receiving an external terminal which projects into the adjacent end of said housing, and said body having a generally cylindrical chamber therein which forms a substantially enclosed chamber which opens into said mouth at the other end of said housing;

a generally cylindrical piston assembly slidably and coaxially mounted within said cylinder of said body and including:

a tubular metallic piston member having an annular piston head portion at one end thereof which portion faces said one end of said insert body, a tubular insulating member fastened to the other end of said piston member coaxially therewith and extending therefrom toward said other end of said housing and completing the external dimensions of said piston assembly, wherein the maximum external diameter of said piston assembly is no greater than the inside diameter of the opening of said insert body adjacent said mouth at said other end of said housing, wherein the axial bores of said piston and insulating members form a through-bore extending through said piston assembly, and a tubular female contact coaxially mounted to said piston member for movement therewith;

a tubular insert tip member coaxially mounted in said mouth at said other end of said housing and adjacent, to the other end of said insert body to complete said bushing plug; and, means including said tubular insert tip member for limiting the maximum translation of said piston assembly in the direction toward said other end of said body.

2. The bushing plug according to claim 1, wherein said insert tip member is removably fastened to said other end of said insert body and wherein said insert tip member includes integral stop means to limit the maximum outward translation of said piston assembly and wherein said piston assembly is slidably removable from said bushing plug upon removal of said insert tip member.

3. A bushing plug having a movable female contact for receiving and making engaging connection with the male electrode of an associated elbow connector, said bushing plug comprising:

an elastomeric housing having a generally tubular configuration about an axis thereof and terminating at either end thereof in a mouth;

a generally tubular metallic insert body fixedly and coaxially mounted within said elastomeric housing, said insert body having a means at one end thereof for receiving an external terminal which projects into the adjacent end of said housing, and said body having a generally cylindrical chamber therein which forms a substantially enclosed chamber which opens into said mouth at the other end of said housing;

a generally cylindrical piston assembly slidably and coaxially mounted within said cylinder of said body and including;

a tubular metallic piston member having an annular piston head portion at one end thereof which portion faces said one end of said insert body, a tubular insulating member fastened to the other end of said piston member coaxially therewith and extending therefrom toward said other end of said housing and completing the external dimensions of said piston assembly, wherein the axial bores of said piston and insulating members form a through-bore extending through said piston assembly, and a tubular female contact coaxially mounted to said piston member for movement therewith;

a tubular insert tip member coaxially mounted in said mouth at said other end of said housing and fastened to the other end of said insert body to complete said bushing plug;

wherein said insert tip member is removably fastened to said other end of said insert body and wherein said insert tip member includes integral stop means to limit the maximum outward translation of said piston assembly and wherein said piston assembly is slidably removable from said bushing plug upon removal of said insert tip member; and, wherein said insert body includes a circumferential stepped transition portion adjacent said one end thereof, thereby to limit the maximum inward translation of said piston assembly and to provide a reduced diameter fixed volume chamber at said one end of said insert body.

4. A bushing plug having a movable female contact for receiving and making engaging connection with the male electrode of an associated elbow connector, said bushing plug comprising:

an elastomeric housing having a generally tubular configuration about an axis thereof and terminating at either end thereof in a mouth;

a generally tubular metallic insert body fixedly and coaxially mounted within said elastomeric housing, said insert body having a means at one end thereof for receiving an external terminal which projects into the adjacent end of said housing, and said body having a generally cylindrical chamber therein which forms a substantially enclosed chamber which opens into said mouth at the other end of said housing;

a generally cylindrical piston assembly slidably and coaxially mounted within said cylinder of said body and including:

a tubular metallic piston member having an annular piston head portion at one end thereof which portion faces said one end of said insert body, a tubular insulating member fastened to the other end of said piston member coaxially therewith and extending therefrom toward said other end of said housing and completing the external dimensions of said piston assembly, wherein the axial bores of said piston and insulating members form a through-bore extending through said piston assembly, and a tubular female contact coaxially mounted to said piston member for movement therewith;

a tubular insert tip member coaxially mounted in said mouth at said other end of said housing and fastened to the other end of said insert body to complete said bushing plug; and, wherein said piston assembly is freely rotatable within said insert body for unrestricted rotation therein.

5. The bushing plug according to claim 1, wherein said insert body is a one-piece integral structure.

6. The bushing plug according to claim 5, wherein said piston member includes at least one circumferential recessed groove for receiving a garter spring therein.

7. The bushing plug according to claim 6, wherein at least the radially inward portion of said insert body between the translation excursions of said garter spring is plated with a layer of Ag.

8. The bushing plug according to claim 1, wherein said tubular insert tip member is removably threadedly fastened to said other end of said insert body.

9. The bushing plug according to claim 1, wherein said tubular insulating member and said tubular insert tip member are respectively threadedly fastened with said piston member and said insert body.

10. A bushing plug having a movable female contact for receiving and making engaging connection with the male electrode of an associated elbow connector, said bushing plug comprising:

an elastomeric housing having a generally tubular configuration about an axis thereof and terminating at either end thereof in a mouth;

a generally tubular metallic insert body fixedly and coaxially mounted within said elastomeric housing, said insert body having a means at one end thereof for receiving an external terminal which projects into the adjacent end of said housing, and said body having a generally cylindrical chamber therein which forms a substantially enclosed chamber which opens into said mouth at the other end of said housing;

a generally cylindrical piston assembly slidably and coaxially mounted within said cylinder of said body and including:

a tubular metallic piston member having an annular piston head portion at one end thereof which portion faces said one end of said insert body, a tubular insulating member fastened to the other end of said piston member coaxially therewith and extending therefrom toward said other end of said housing and completing the external dimensions of said piston assembly, wherein the axial bores of said piston and insulating members form a through-bore extending through said piston assembly, and a tubular female contact coaxially mounted to said piston member for movement therewith;

a tubular insert tip member coaxially mounted in said mouth at said other end of said housing and fastened to the other end of said insert body to complete said bushing plug; and, wherein the maximum translation of said piston assembly in the direction toward said other end of said body is solely limited by a removable stop member mounted to said housing adjacent said other end of said body.

11. The bushing plug according to claim 10, wherein said stop member comprises an axial extension of said insert tip member which extends into said housing.

12. The bushing plug according to claim 1, wherein said tubular female contact extends coaxially into said tubular insulating member in overlapping, spaced-apart relationship therewith.

13. The bushing plug according to claim 1, wherein the outside diameter of said annular piston head portion is no greater than the inside diameter of that portion of said insert body which extends from said mouth at said other end of said housing to the point of maximum inward translation of said piston assembly.

14. The bushing plug according to claim 13, wherein said inward portion of said insert body is a right circular cylinder.

15. The bushing plug according to claim 14, wherein the major portion of said piston assembly is substantially a right circular cylinder.

16. The bushing plug according to claim 1, wherein said tubular female contact is mounted within said piston.

17. The bushing plug according to claim 1, wherein at least a portion of said tubular insulating member comprises an arc-responsive material for evolving arc-quenching gas in response to an arc being struck between said male electrode and said female contact.

18. The bushing plug according to claim 17, wherein said means for receiving an external terminal comprises a threaded bore for receiving a threaded fastener.

19. The bushing plug according to claim 1, wherein said piston assembly includes first and second axially spaced annular raised portions circumferentially disposed about said assembly for slidably engaging the said cylinder.

20. The bushing plug according to claim 1, wherein said male electrode includes a tubular arc follower member at its free end and wherein said arc follower extends through and projects from said piston assembly when said bushing plug and elbow connector are fully engaged.

21. A bushing plug having a movable female contact for receiving and making engaging connection with the male electrode of an associated elbow connector, said bushing plug comprising:

an elastomeric housing having a generally tubular configuration about an axis thereof and terminating at each end thereof in a mouth;

a generally tubular metallic insert body fixedly and coaxially mounted within said elastomeric housing, said insert body having a means at one end thereof for receiving an external terminal which projects into the adjacent end of said housing, and said body having a generally cylindrical chamber therein which forms a substantically enclosed chamber which opens into said mouth at the other end of said housing;

a generally cylindrical removable piston assembly slidably and coaxially mounted within said cylindrical chamber of said body and wherein the maximum outside diameter of said piston assembly is no greater than the corresponding inside diameter of said cylindrical chamber wherein said removable piston assembly is insertable into said cylindrical chamber from said mouth at said other end of said housing, said piston assembly including:

a tubular metallic piston member having an annular piston head portion at one end thereof which portion faces said one end of said insert body, a tubular insulating member fastened to the other end of said piston member coaxially therewith and extending therefrom toward said other end of said housing and completing the external dimensions of said piston assembly, wherein the axial bores of said piston and insulating members form a through-bore extending through said piston assembly, and a tubular female contact coaxially mounted to said piston member for movement therewith; and, a tubular insert tip member coaxially and removably mounted in said mouth at said other end of said housing and fastened to the other end of said insert body to complete said bushing plug, and wherein the inside diameter of said tubular insert tip member is less than said maximum outside diameter of said piston assembly thereby to limit the translation of said piston assembly and whereby said piston assembly is removable from said housing upon the removal of said tubular insert tip member from said housing.

22. A bushing plug having a movable female contact for receiving and making engaging connection with the male electrode of an associated elbow connector, said bushing plug comprising:

an elastomeric housing having a generally tubular configuration about an axis thereof and terminating at each end thereof in a mouth;

a generally tubular metallic insert body fixedly and coaxially mounted within said elastomeric housing, said insert body having a means at one end thereof for receiving an external terminal which projects into the adjacent end of said housing, and said body having a generally cylindrical chamber therein which forms a substantially enclosed chamber which opens into said mouth at the other end of said housing;

a generally cylindrical removable piston assembly slidably and coaxially mounted within said cylindrical chamber of said body and wherein the maximum outside diameter of said piston assembly is no greater than the inside diameter of said cylindrical chamber, said piston assembly including:

a tubular metallic piston member having an annular piston head portion at one end thereof which portion faces said one end of said insert body, a tubular insulating member fastened to the other end of said piston member coaxially therewith and extending therefrom toward said other end of said housing and completing the external dimensions of said piston assembly, wherein the axial bores of said piston and insulating members form a through-bore extending through said piston assembly, and a tubular female contact coaxially mounted to said piston member for movement therewith;

a tubular insert tip member coaxially and removably mounted in said mouth at said other end of said housing and fastened to the other end of said insert body to complete said bushing plug, and wherein the inside diameter of said tubular insert tip member is less than said maximum outside diameter of said piston assembly thereby to limit the translation of said piston assembly and whereby said piston assembly is removable from said housing upon the removal of said tubular insert tip member from said housing; and, wherein said piston member includes a stepped portion intermediate the ends thereof and projecting radially outwardly to a radius equal to the radius of said maximum diameter and wherein said raised portion engages said tubular insert tip menber.

23. A bushing plug having a movable female contact for receiving and making engaging connections with the male electrode of an associated elbow connector, said bushing plug comprising:

an elastomeric housing having a generally tubular configuration about an axis thereof and terminating at each end thereof in a mouth;

a generally tubular metallic insert body fixedly and coaxially mounted within said elastomeric housing, said insert body having a means at one end thereof for receiving an external terminal which projects into the adjacent end of said housing, and said body having a generally cylindrical chamber therein which forms a substantially enclosed chamber which opens into said mouth at the other end of said housing;

a generally cylindrical and removable piston assembly slidably and coaxially mounted within said cylindrical chamber of said body wherein the maximum diameter of said cylindrical removable piston assembly is no greater than the inside diameter of the opening of said insert body at said mouth at said other end of said housing so that said assembly can be inserted into said insert body after said insert body is mounted within said elastomeric housing, and said assembly including:

a tubular metallic piston member having an annular piston head portion at one end thereof which portion faces said one end of said insert body, a tubular insulating member fastened to the other end of said piston member coaxially therewith and extending therefrom toward said other end of said housing and completing the external dimensions of said piston assembly, wherein the axial bores of said piston and insulating members form a through-bore extending through said piston assembly, and a tubular female contact coaxially mounted to said piston member of movement therewith;

a tubular insert tip member coaxially mounted in said mouth at said other end of said housing and adjacent to the other end of said insert body to complete said bushing plug; and, a resilient O-ring mounted in a recessed annular groove provided in one of the radially inwardly surface of said tubular insert tip member or the radially outwardly surface of said tubular insulating member for frictionally and sealingly engaging said surfaces.

24. The bushing plug according to claim 23, wherein the other of said surfaces includes a recessed annular groove forming a seat for said "O"-ring which is in registry with the other of said grooves when said piston is fully translated into said housing, thereby to provide a releasable, snap-lock frictional engagement therebetween.

* * * * *